US006571709B1

(12) United States Patent
Marincic et al.

(10) Patent No.: US 6,571,709 B1
(45) Date of Patent: Jun. 3, 2003

(54) APPARATUS AND METHOD FOR PICKING PRINTING PLATES OF VARIOUS SIZES

(75) Inventors: Thomas Marincic, Tyngsboro, MA (US); Aron Mirmelshteyn, Marblehead, MA (US)

(73) Assignee: Agfa Corporation, Wilmington, MA (US)

( * ) Notice: Subject to any disclaimer, the term of this patent is extended or adjusted under 35 U.S.C. 154(b) by 0 days.

(21) Appl. No.: 10/045,551

(22) Filed: Jan. 10, 2002

(51) Int. Cl.[7] ..... B41L 47/14; B65H 3/08

(52) U.S. Cl. ..... 101/477; 101/389.1; 101/485; 414/797; 271/90; 294/64.1

(58) Field of Search ..... 101/477, 409, 101/479, 480, 483, 389.1, 485; 271/90, 108; 414/797; 294/64.1, 65; 269/21; 29/559; 451/388; 409/225; 279/3; 355/73

(56) References Cited

U.S. PATENT DOCUMENTS

| | | | | |
|---|---|---|---|---|
| 715,905 A | | 12/1902 | Tuck et al. | |
| 2,198,765 A | | 4/1940 | Featherstone et al. | |
| 2,680,994 A | | 6/1954 | Wood | |
| 3,307,819 A | | 3/1967 | Cocito | |
| 3,617,048 A | * | 11/1971 | Albert | 271/108 |
| 3,754,751 A | | 8/1973 | Capetti et al. | |
| 3,907,268 A | | 9/1975 | Hale | |
| 3,991,997 A | * | 11/1976 | Barber | 271/108 |
| 4,221,356 A | | 9/1980 | Fortune | |
| 4,744,297 A | | 5/1988 | Sardella et al. | |
| 4,787,662 A | | 11/1988 | Dewez | |
| 4,793,657 A | * | 12/1988 | Mense | 294/65 |
| 5,149,162 A | | 9/1992 | Focke et al. | |
| 5,177,857 A | | 1/1993 | Ito | |
| 5,960,821 A | | 10/1999 | Johnson | |

* cited by examiner

*Primary Examiner*—Leslie J. Evanisko
(74) *Attorney, Agent, or Firm*—John A. Merecki

(57) ABSTRACT

A vacuum system is provided including a vacuum source and plurality of suction cups coupled to the vacuum source, wherein at least one of the suction cups is coupled to the vacuum source using a non-constricted fitting, and wherein at least one of the suction cups is coupled to vacuum source using a fixed orifice fitting. The vacuum system is configured to pick a top printing plate from the stack of printing plates, such that each suction cup coupled to the vacuum source using a non-constricted fitting is configured to always engage the top printing plate.

29 Claims, 13 Drawing Sheets

APPARATUS AND METHOD FOR PICKING PRINTING PLATES OF VARIOUS SIZES

FIELD OF THE INVENTION

The present invention is in the field of imaging systems. More particularly, the present invention provides an apparatus and method for picking printing plates of various sizes.

BACKGROUND OF THE INVENTION

In external drum imaging systems, a movable optical carriage is commonly used to displace an image exposing or recording source in a slow scan direction while a cylindrical drum supporting recording media on an external surface thereof is rotated with respect to the image exposing source. The drum rotation causes the recording media to advance past the exposing source along a direction which is substantially perpendicular to the slow scan direction. The recording media is therefore advanced past the exposing source by the rotating drum in a fast scan direction.

An image exposing source may include an optical system for scanning one or more exposing or recording beams. Each recording beam may be separately modulated according to a digital information signal representing data corresponding to the image to be recorded.

The recording media to be imaged by an external drum imaging system is commonly supplied in discrete, flexible sheets and may comprise a plurality of plates, hereinafter collectively referred to as "plates" or "printing plates." Each printing plate may comprise one or more layers supported by a support substrate, which for many printing plates is a plano-graphic aluminum sheet or a polyester support. Other layers may include one or more image recording (i.e., "imageable") layers such as a photosensitive, radiation sensitive, or thermally sensitive layer, or other chemically or physically alterable layers. Printing plates are available in a wide variety of sizes, typically ranging, e.g., from 9"×12", or smaller, to 58"×80", or larger.

A vacuum system, comprising a plurality of suction cups coupled to a vacuum source, is often employed to lift, or "pick," the top printing plate from a stack of printing plates, prior to the top printing plated being fed to the external drum of an imaging system. One cost-effective method of simultaneously distributing a vacuum to the plurality of suction cups involves the use of a single venturi vacuum pump. An example of such a vacuum system 10 is illustrated in FIG. 1. In particular, the vacuum system 10 includes a vacuum pump 12 for generating a vacuum, a plurality of suction cups 14A–14F, tubing 16, and identical, non-constricted (i.e., "straight-through") fittings 22 for coupling the suction cups 14A–14F in parallel to the vacuum pump 12 via tubing 16. In this configuration, a vacuum provided by the vacuum pump 12 is simultaneously applied and distributed to each of the plurality of suction cups 14A–14F.

As depicted in FIG. 2, the vacuum system 10 may be used to pick the top printing plate 18 off of a stack 20 of printing plates. When the top printing plate 18 has a width $W_P$ greater than the effective width $W_{SC}$ of the plurality of suction cups 14A–14F sufficient vacuum is available at each of the suction cups 14A–14F to allow the top printing plate 18 to be lifted from the stack 20 of printing plates.

Problems may occur, however, when the vacuum system 10 is used to pick up a printing plate 18 having a width $W_P$ substantially narrower than the effective width $W_{SC}$ of the plurality of suction cups 14A–14F. For example, as shown in FIG. 3, only two of the suction cups (i.e., suction cups 14C and 14D) fully engage the top printing plate 18 in a stack of printing plates 20. The remaining suction cups 14A, 14B, 14E, and 14F, do not fully engage the top printing plate 18 and remain open to the atmosphere. As such, due to substantial vacuum leakage through the open suction cups 14A, 14B, 14E, and 14F, there is often insufficient remaining vacuum generated at suction cups 14C and 14D to enable the smaller printing plate 18 to be picked up and held by the vacuum system 10.

To accommodate a variety of different size printing plates, and to avoid the vacuum leakage problems detailed above, available vacuum systems often employ a manifold-type vacuum system, wherein a manifold is configured to selectively apply a vacuum to a plurality of suction cups based on the size of the printing plate to be picked up. Although quite effective, such manifold-type vacuum systems typically have a complex structure, and are expensive to implement, operate, and maintain.

A need therefore exists for simple and inexpensive vacuum system, such as the vacuum system illustrated in FIG. 1, that is capable of picking various size printing plates while controlling the leakage flow through the suction cups that do not engage a printing plate during the picking process.

SUMMARY OF THE INVENTION

The present invention provides an apparatus and method for picking printing plates from a stack of printing plates.

Generally, the present invention provides an apparatus, comprising:

- a vacuum system including a vacuum source and plurality of suction cups coupled to the vacuum source, wherein at least one of the suction cups is coupled to the vacuum source using a non-constricted fitting, and wherein at least one of the suction cups is coupled to vacuum source using a fixed orifice fitting; and
- a stack of printing plates;
- wherein the vacuum system is configured to pick a top printing plate from the stack of printing plates, and wherein each suction cup coupled to the vacuum source using a non-constricted fitting is configured to always engage the top printing plate.

The present invention also provides a method, comprising:

- providing a vacuum system including a vacuum source and plurality of suction cups coupled to the vacuum source;
- coupling at least one of the suction cups to the vacuum source using a non-constricted fitting;
- coupling at least one of the suction cups to the vacuum source using a fixed orifice fitting; and
- picking a top printing plate from a stack of printing plates using the vacuum system, wherein each suction cup coupled to the vacuum source using a non-constricted fitting is configured to always engage the top printing plate.

The present invention further provides a method for picking and holding an object, comprising:

- providing a vacuum system including a vacuum source and plurality of suction cups coupled to the vacuum source;
- coupling at least one of the suction cups to the vacuum source using a non-constricted fitting;
- coupling at least one of the suction cups to the vacuum source using a fixed orifice fitting; and
- picking and holding an object using the vacuum system, wherein each suction cup coupled to the vacuum source using a non-constricted fitting always engages and holds the object, wherein zero or more of the suction cups coupled to the vacuum source using a fixed orifice fitting engage and hold the object, and wherein vacuum leakage through any suction cups that do not engage the object does not substantially affect a vacuum level within the suction cups that do engage the object.

BRIEF DESCRIPTION OF THE DRAWINGS

The features of the present invention will best be understood from a detailed description of the invention and embodiments thereof selected for the purpose of illustration and shown in the accompanying drawings in which.

DETAILED DESCRIPTION OF THE INVENTION

Figure 1:
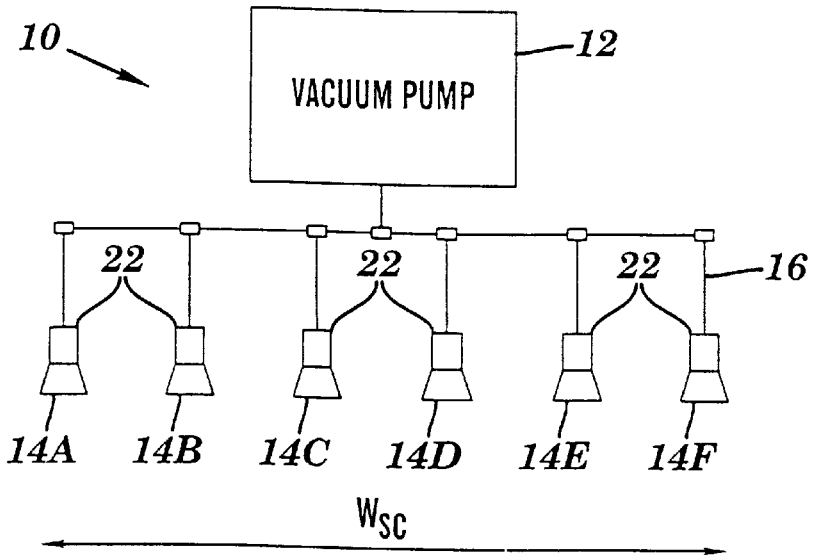
FIG. 1 RELATED ART
FIG. 1 illustrates a vacuum system for picking up a printing plate from a stack of printing plates in accordance with the related art.
Figure 2:
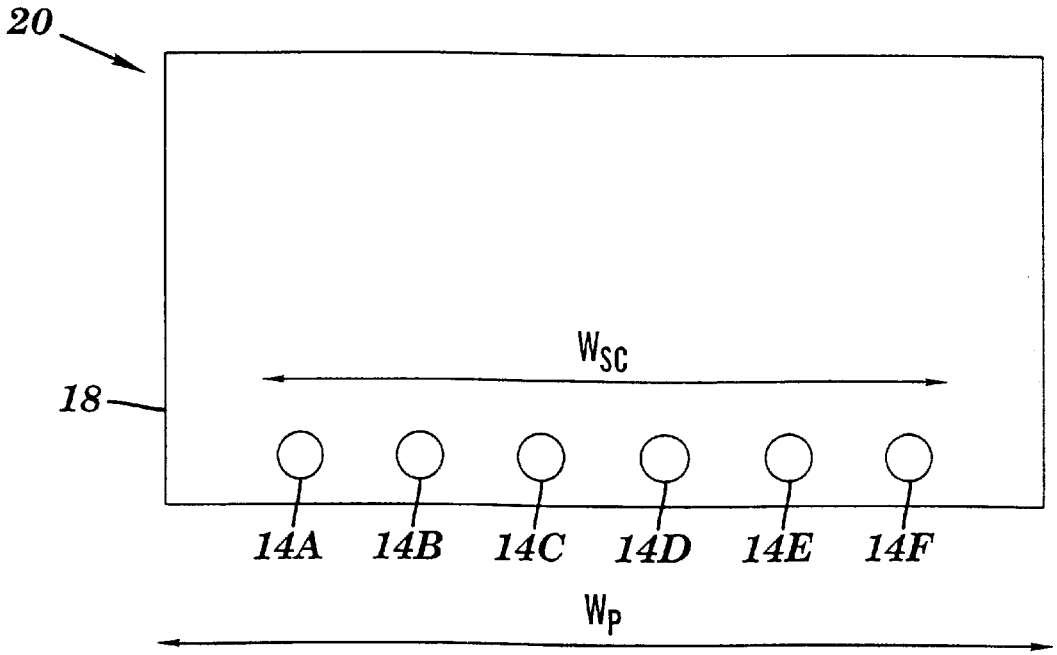
FIG. 2 RELATED ART
FIG. 2 illustrates the vacuum system of FIG. 1 picking up a printing plate that is wider than the effective width of the suction cups of the vacuum system.
Figure 3:
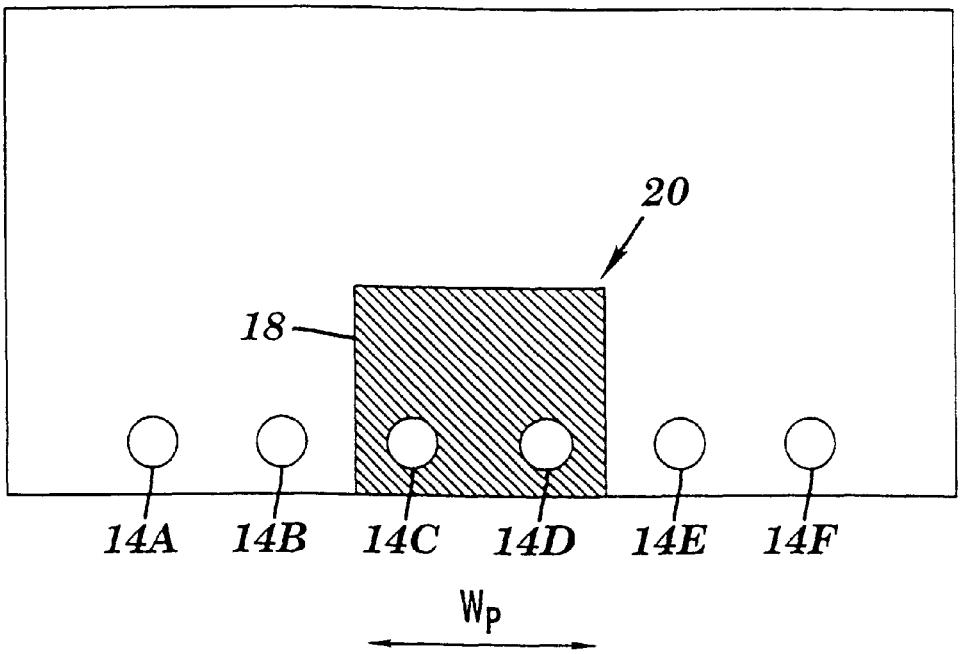
FIG. 3 RELATED ART
FIG. 3 illustrates the vacuum system of FIG. 1 picking up a printing plate having a width that is narrower than the effective width of the suction cups of the vacuum system.

The features of the present invention are illustrated in detail in the accompanying drawings, wherein like reference numerals refer to like elements throughout the drawings. Although the drawings are intended to illustrate the present invention, the drawings are not necessarily drawn to scale.

Figure 4:
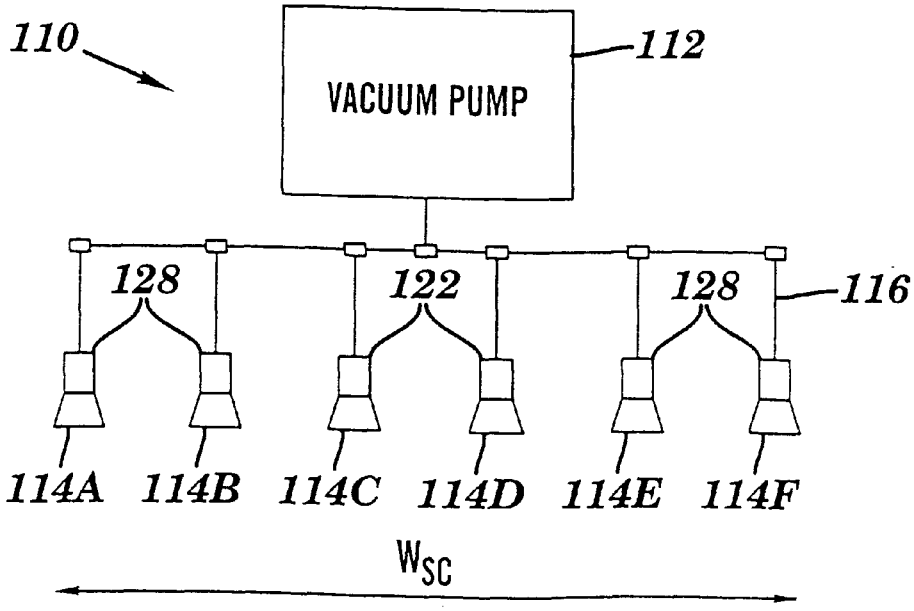
FIG. 4 illustrates a vacuum system for picking up a printing plate from a stack of printing plates in accordance with the present invention.
Figure 5:
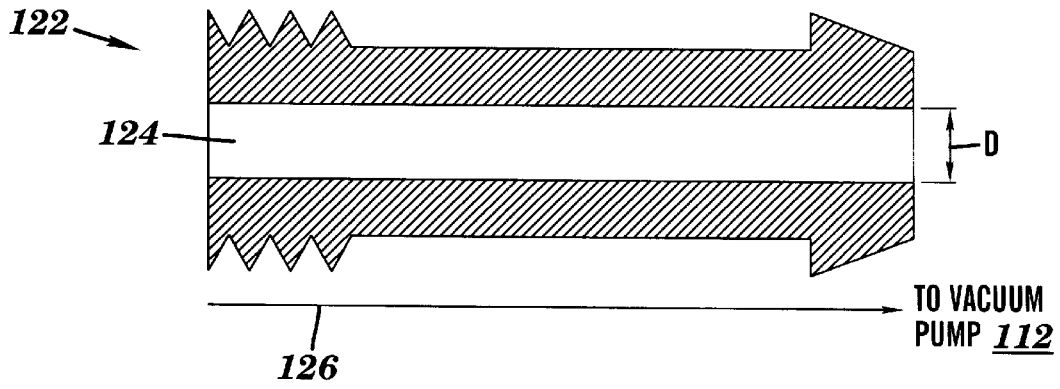
FIG. 5 illustrated a non-constricted fitting used in the vacuum system of FIG. 4.

A vacuum system 110 for picking up a printing plate from a stack of printing plates in accordance with the present invention is illustrated in FIG. 4. In particular, the vacuum system 110 includes a vacuum source (e.g. vacuum pump) 112 for generating a vacuum, a plurality of suction cups 114A–114F, tubing 116, and non-constricted fittings 122 for coupling at least one suction cup (e.g., suction cups 114C, 114D in this embodiment) in parallel to the vacuum pump 112 via tubing 116. As shown in FIG. 5, the non-constricted fittings 122 may comprise, for example, a tubular structure having a bore 124 with a constant diameter D. Airflow direction through the non-constricted fitting 122 is indicated by directional arrow 126. Other structures which do not substantially restrict the airflow therethrough may also be used in the practice of the present invention.

Figure 6:
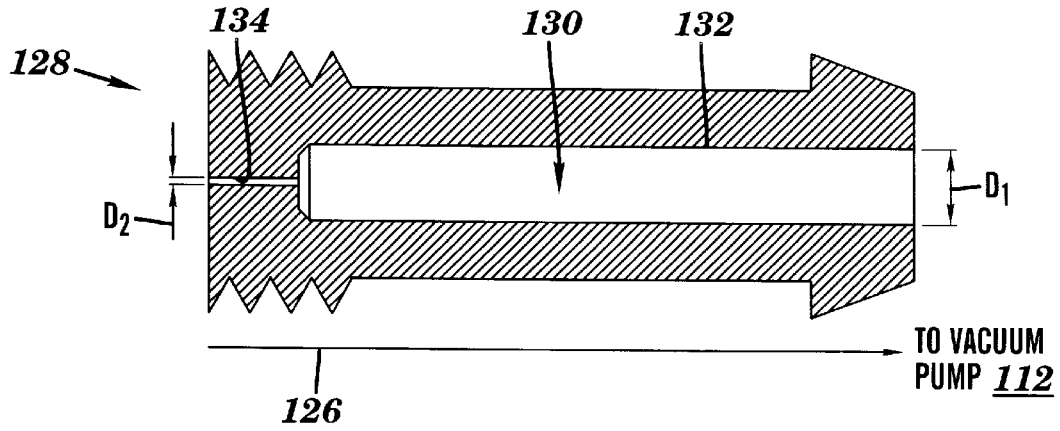
FIG. 6 illustrates a fixed orifice fitting used in the vacuum system of FIG. 4.

In addition, as illustrated in FIG. 4, unlike the related art vacuum system 10 shown in FIG. 1, the vacuum system 110 further includes a plurality of suction cups 114A, 114B, 114E, and 114F, which are coupled in parallel to the vacuum pump 112 via tubing 116 using fixed orifice fittings 128. Thus, a combination of fixed orifice fittings 128 and non-constricted fittings 122 are used in the present invention. An example of a suitable fixed orifice fitting 128 is illustrated in FIG. 6. In particular, the fixed orifice fitting 128 includes a bore 130 having a tubular portion 132 with a diameter $D_l$, and a restricted tubular portion 134 with a diameter $D_2$ that is substantially smaller than $D_1$. Airflow direction through the fixed orifice fitting 128 is indicated by directional arrow 126. Many other configurations of the fixed orifice fitting 128 are also possible.

Figure 7:
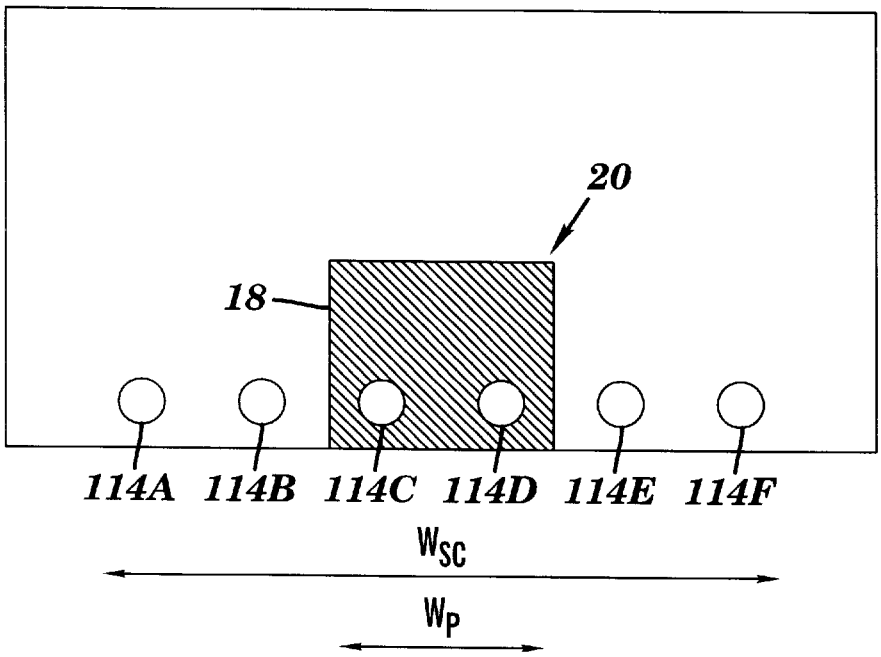
FIG. 7 illustrates the vacuum system of FIG. 4 picking up a printing plate having a width that is narrower than the effective width of the suction cups of the vacuum system.

When the vacuum system 110 is used to pick up a printing plate 18 having a width $W_P$ substantially narrower than the effective width $W_{SC}$ of the plurality of suction cups 114A–114E, as shown, for example, in FIG. 7, only two of the suction cups (i.e., suction cups 114C and 114D) fully engage the top printing plate 18 in the stack of printing plates 20. The remaining suction cups 114A, 114B, 114E, and 114F, do not fully engage the top printing plate 18 and remain open to the atmosphere. However, the restricted tubular portion 134 of the fixed orifice fittings 128 drastically reduces vacuum leakage through the open suction cups 114A, 114B, 114E, and 114F, such that the vacuum level in the remaining suction cups 114C and 114D is sufficient to hold and pick up the smaller sized printing plate 18. As shown in FIG. 7, the suction cups 114A–114F may be arranged in a line parallel to the bottom edge of the printing plate 18.

Figure 8:
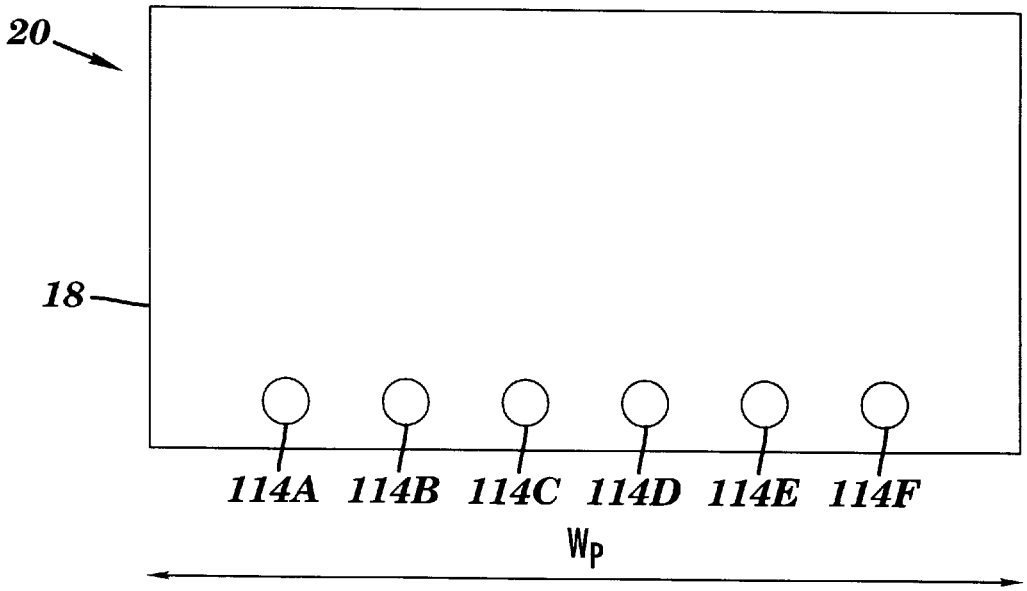
FIG. 8 illustrates the vacuum system of FIG. 4 picking up a printing plate that is wider than the effective width of the suction cups of the vacuum system.

The fixed orifice fittings 128 do not effect the ability of the vacuum system 110 to lift larger size printing plates. For example, as shown in FIG. 8, all of the suction cups, including suction cups 114C and 114D, which are coupled to non-constricted fittings 122, and suction cups 114A, 114B, 114E, and 114F, which are coupled to fixed orifice fittings 128, may be used to hold and pick up a larger size printing plate 18 from a stack of printing plates 20. In this case, negative pressure in each of the suction cups 114A, 114B, 114E, and 114F, balances out on both sides of the fixed orifice fitting 128 such that each suction cup 114A, 114B, 114E, and 114F, provides the same holding force as either of the suction cups 114C and 114D, which do not have fixed orifice fittings.

In the above description of the present invention, two suction cups 114C and 114D are described as having non-constricted fittings 122. A minimum of one suction cup having a non-constricted fitting 122 may be used in the practice of the present invention. In addition, a minimum of one suction cup having a fixed orifice fitting 128 may be used in the practice of the present invention.

Figure 9:
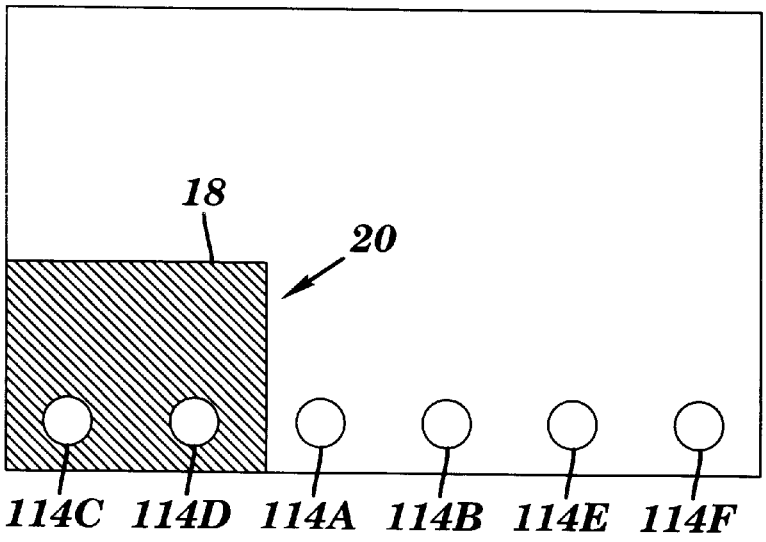
FIGS. 9 and 10 illustrate the use of the vacuum system of the present invention with a stack of left and right justified printing plates, respectively.
Figure 10:
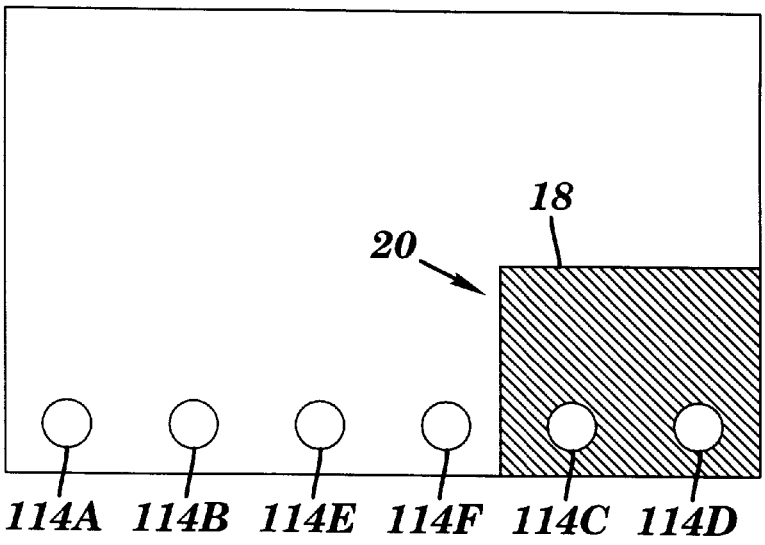

The vacuum system 110 shown in FIGS. 4, 7, and 8, is configured for use with a stack 20 of center justified printing plates 18. In particular, the suction cups 114C and 114D are located in the center of the array of suction cups 114A–114F. In this way the suction cups 114C and 114D having the non-constricted fittings 122 are positioned to engage a center portion of any size printing plate 18. In the alternative, the vacuum system 110 can be reconfigured for use with a stack 20 of right or left justified printing plates 18 by shifting the relative positions of the suction cups 114A–114F as shown in FIG. 9 (left justified) and FIG. 10 (right justified).

Figure 11:
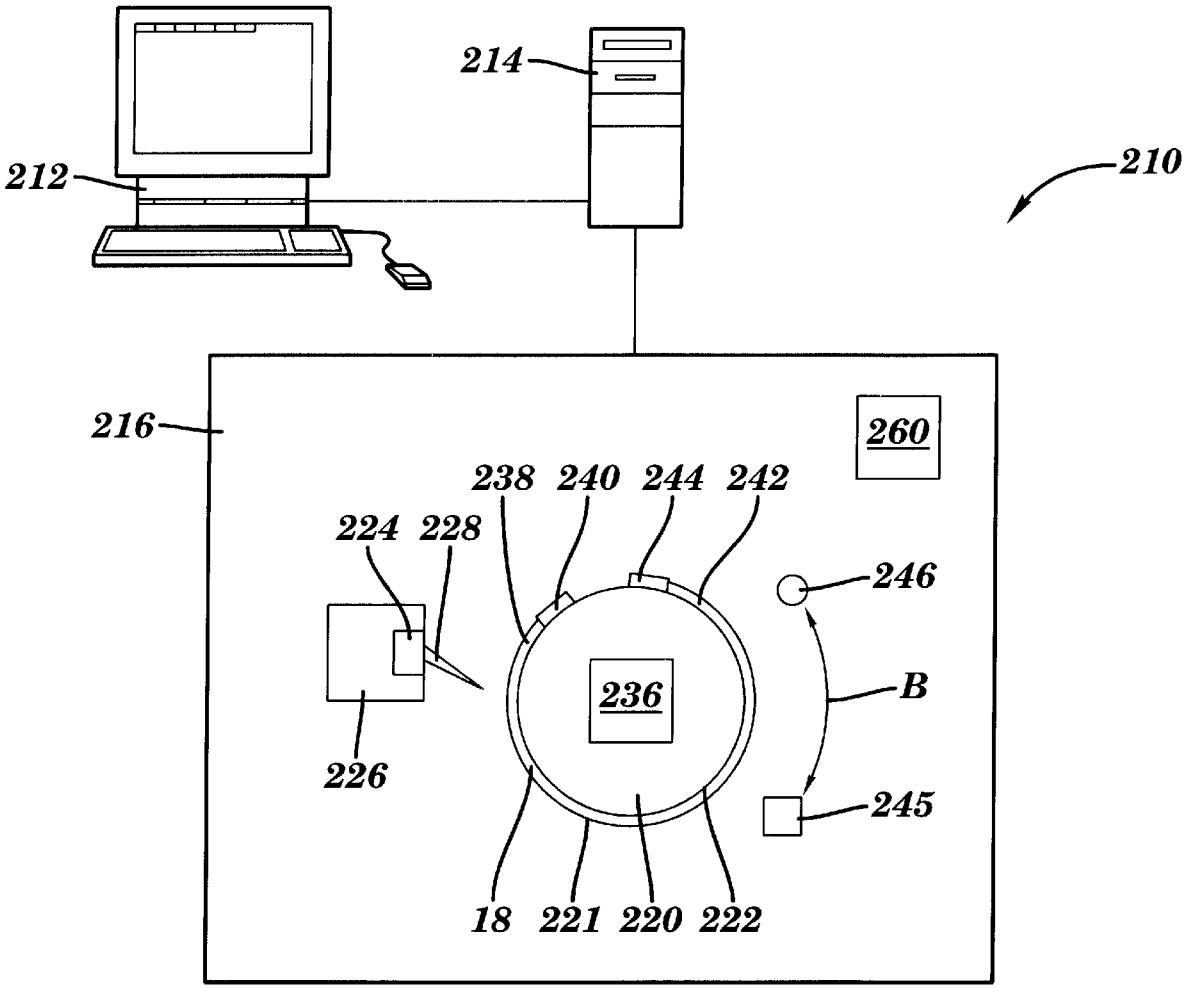
FIG. 11 illustrates an external drum imaging system for recording images onto a printing plate.

The vacuum system 110 of the present invention is configured to pick and hold printing plates 18 in an imaging system, such as the external drum imaging system 210 illustrated in FIG. 11. In general, the imaging system 210 comprises an external drum platesetter configured to record digital data onto a printing plate 18. Although described below with regard to an external drum platesetter, the vacuum system 110 of the present invention may be used in conjunction with a wide variety of other types of external drum, internal drum, or flatbed imaging systems, including imagesetters and the like, without departing from the intended scope of the present invention. In addition, the vacuum system 110 of the present invention may be used to pick and hold other objects besides printing plates.

The imaging system 210 generally includes a front end computer or workstation 212 for the design, layout, editing, and/or processing of digital files representing pages to be printed, a raster image processor (RIP) 214 for further processing the digital pages to provide rasterized page data (e.g., rasterized digital files) for driving an image recorder, and an image recorder or engine, such as an external drum platesetter 216, for recording the rasterized digital files onto a printing plate or other recording media. The external drum platesetter 216 records the digital data (i.e., "job") provided by the RIP 214 onto a supply of photosensitive, radiation sensitive, thermally sensitive, or other type of suitable printing plate 18.

A plurality of printing plates 18 are supplied in a stack to the external drum platesetter, and are individually fed from the stack by an autoloading system 260 and mounted on an external drum 220. The stack of printing plates 18 may be located within a cassette 275.

Figure 12:
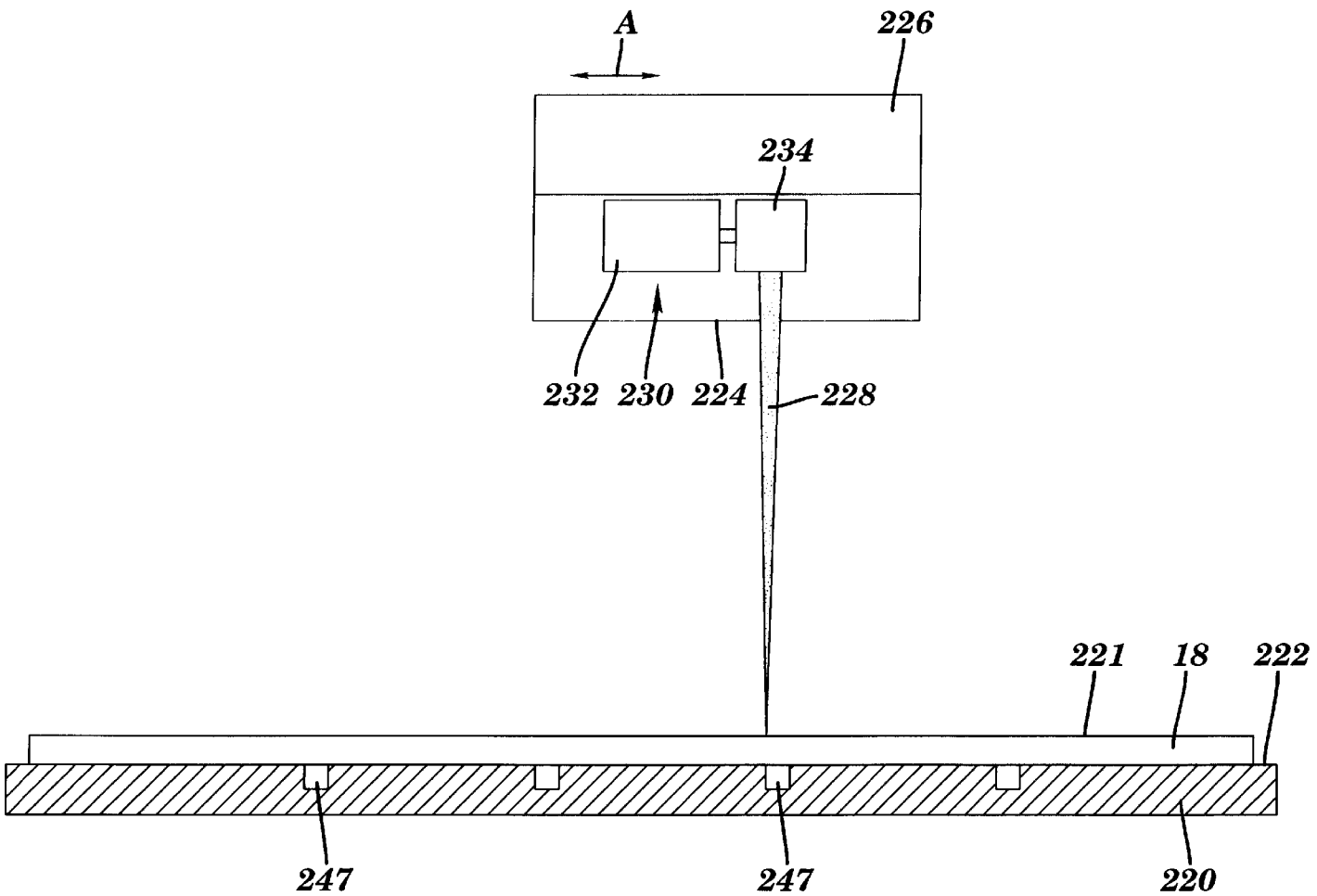
FIG. 12 illustrates an example of an imaging system including a movable optical carriage and scanning system, usable in the external drum imaging system of FIG. 11.

The external drum platesetter 216 includes an external drum 220 having a cylindrical media support surface 222 for supporting the printing plate 18 during imaging. The external drum platesetter 216 further includes a scanning system 224, coupled to a movable carriage 226, for recording digital data onto the imaging surface 221 of the printing plate 18 using a single or multiple imaging beams 228. An example of a scanning system 224 is illustrated in FIG. 12. In particular, the scanning system 224 is displaced by the movable carriage 226 in a slow scan axial direction (directional arrow A) along the length of the rotating external drum 220 to expose the printing plate 18 in a line-wise manner when a single beam is used or in a section-wise manner for multiple beams. Other types of imaging systems may also be used in the present invention.

The external drum 220 is rotated by a drive system 236 in a clockwise or counterclockwise direction as indicated by directional arrow B in FIG. 11. Typically, the drive system 236 rotates the external drum 220 at a rate of about 100–1000 rpm. As further illustrated in FIG. 12, the scanning system 224 typically includes a system 230 for generating the imaging beam or beams 228. The system 230 comprises a light or radiation source 232 for producing the imaging beam or beams 228 (illustrated for simplicity as a single beam), and an optical system 234 positioned between the radiation source 232 and the media support surface 222 for focusing the imaging beam or beams 228 onto the printing plate 18. It should be noted, however, that the system 230 described above is only one of many possible different types of scanning systems that may be used to record image data on the printing plate 18.

In the external drum imaging system 210 shown in FIG. 11, the leading edge 238 of the printing plate 18 is held in position against the media support surface 222 by a leading edge clamping mechanism 240. Similarly, the trailing edge 242 of the printing plate 18 is held in position against the media support surface 222 by a trailing edge clamping mechanism 244. Both the trailing edge clamping mechanism 244 and the leading edge clamping mechanism 240 provide a tangential friction force between the printing plate 18 and the external drum 220 sufficient to resist the tendency of the edges of the printing plate 18 to pull out of the clamping mechanisms 240, 244, at a high drum rotational speed. Other known systems for mounting the printing plate 18 onto the external drum 220 may also be used.

An ironing roller system 246 may be provided to flatten the printing plate 18 against the media support surface 222 of the external drum 220 as the external drum 220 rotates past the ironing roller 246 during the loading of the printing plate 18. Alternately, or in addition, a vacuum source 245 may be used to draw a vacuum through an arrangement of ports and vacuum grooves 247 (see, e.g., FIG. 12) formed in the media support surface 222 to hold the printing plate 18 against the media support surface 222. A registration system (not shown), comprising, for example, a set of registration pins or stops on the external drum 220, and a plate edge detection system (not shown), may be used to accurately and repeatably position and locate the printing plate 18 on the external drum 220.

Figure 13:
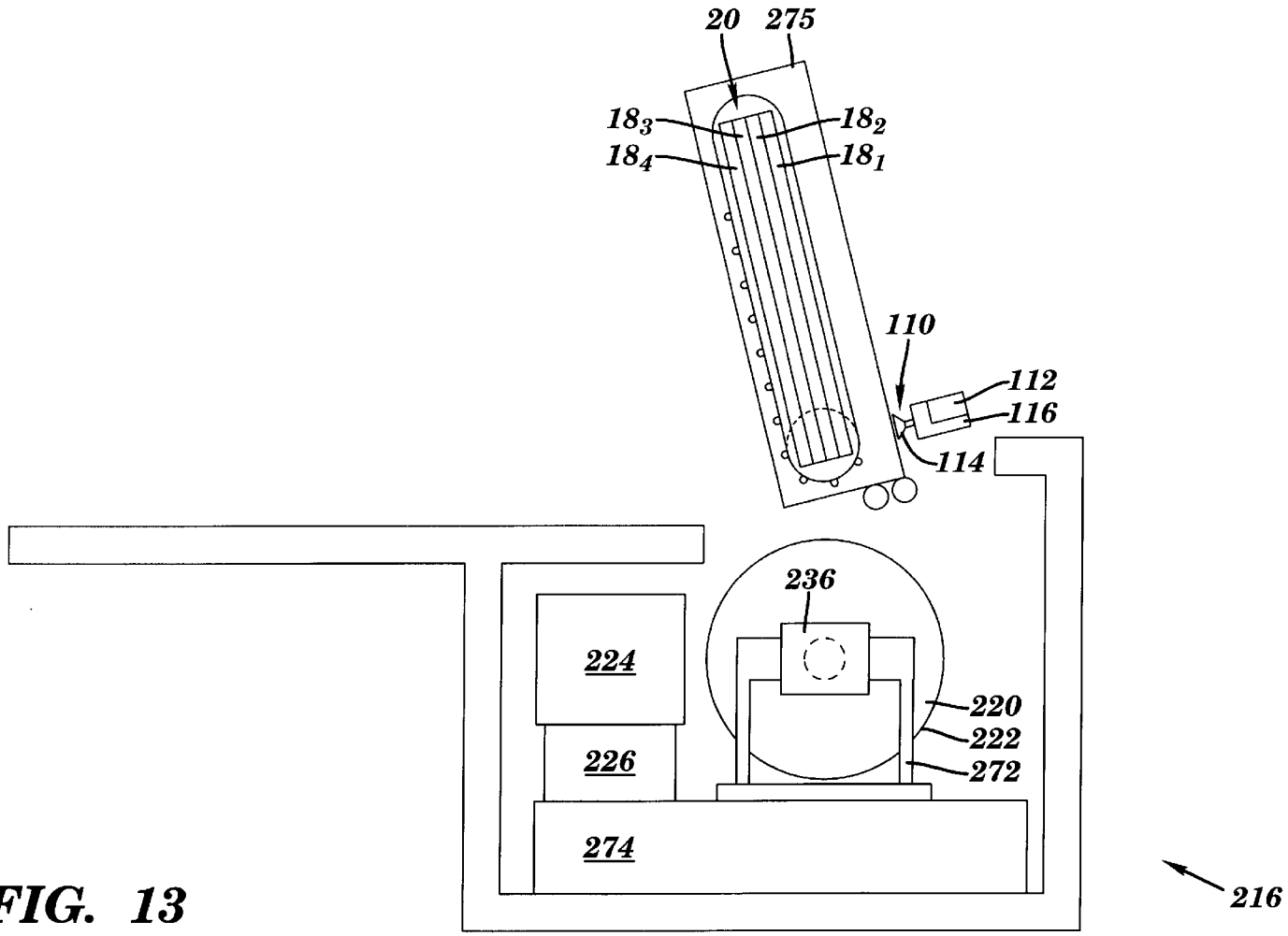
FIGS. 13–18 illustrate the operation of a vacuum system in accordance with the present invention.

The basic structure of an external drum platesetter 216 including a stack 20 of printing plates 18 (e.g., $\mathbf{18}_1$, $\mathbf{18}_2$, $\mathbf{18}_3$, $\mathbf{18}_4$) and the vacuum system 110 of the present invention is illustrated in FIG. 13. The external drum platesetter 216 includes an external drum 220 having a cylindrical media support surface 222 for supporting a printing plate 18 during imaging. The external drum 220 is supported by a frame 272. A drive system 236 rotates the external drum 220 during imaging. A scanning system 224, carried by a movable carriage 226, travels axially along the rotating external drum 220 to record digital data onto the imaging surface of the printing plate (see, e.g., FIG. 12). The external drum 220 and scanning system 224 are positioned on a base 274.

The stack 20 contains a plurality of printing plates 18 (e.g., twenty-five printing plates). Only four printing plates $\mathbf{18}_1$, $\mathbf{18}_2$, $\mathbf{18}_3$, $\mathbf{18}_4$, are illustrated in FIG. 13 for clarity. In this embodiment of the invention, protective slip sheets are not present between the individual printing plates 18 of the stack 20.

The vacuum system 110 is used to pick up a bottom edge of the top printing plate $\mathbf{18}_1$, from the stack 20. As detailed above, the vacuum system 110 generally comprises a plurality of suction cups 114 (e.g., 114A–14F) arranged parallel to the bottom edge of the printing plates in the stack 20. A system 116 for displacing the suction cups 114 toward and away from the top printing plate $\mathbf{18}_1$, and the vacuum pump 112 for supplying a vacuum to the suction cups 114, are also illustrated in FIG. 13.

An example of the operation of the vacuum system 110 of the present invention is illustrated in FIGS. 14–18.

Figure 14:
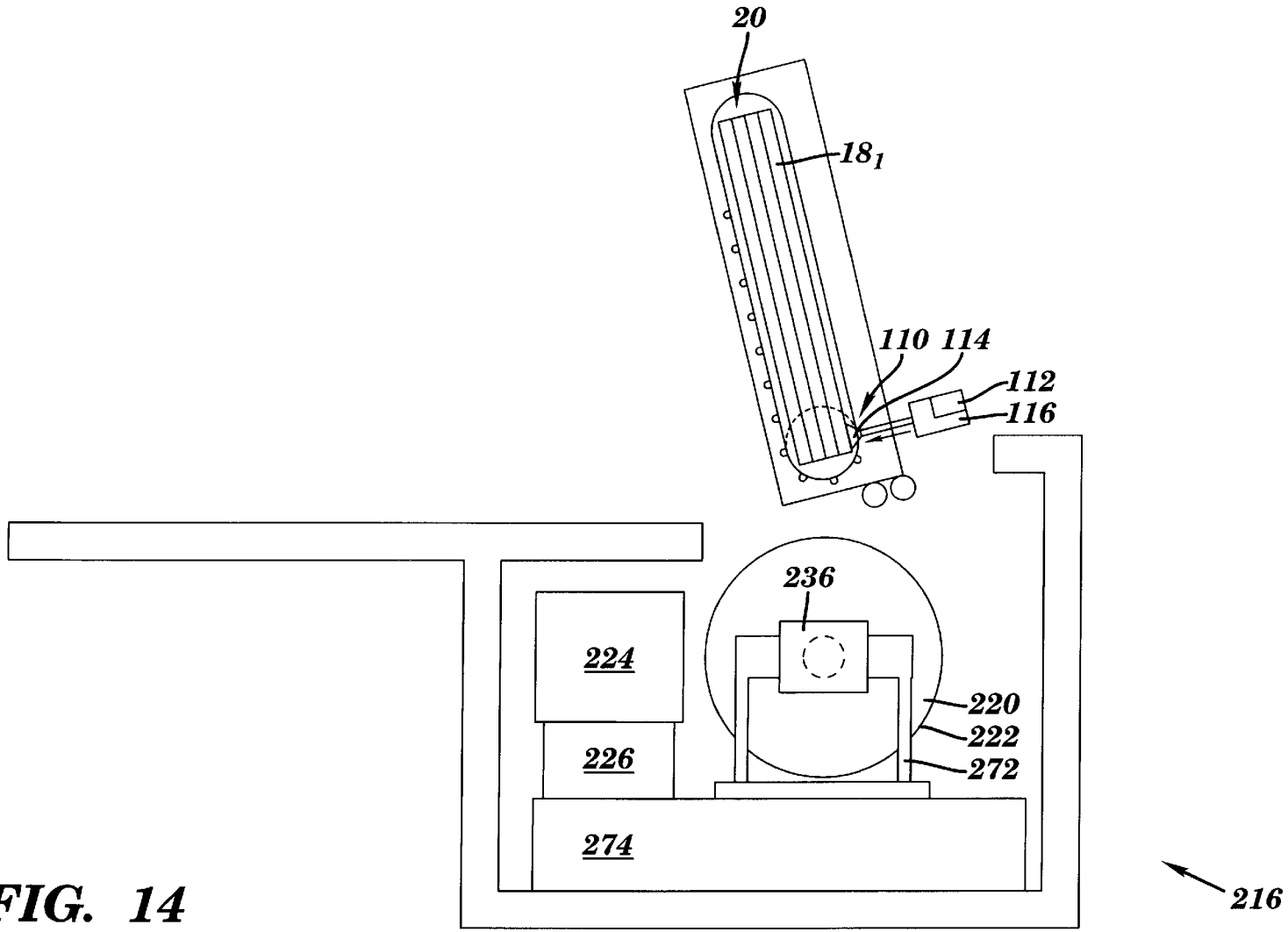

In FIG. 14, the suction cups 114 are moved by the displacing system 116 into contact with a bottom edge of the top printing plate $\mathbf{18}_1$, on the stack 20 of printing plates. A vacuum is applied to the suction cups 114 by the vacuum pump 112, thereby securely coupling the bottom edge of the top printing plate $\mathbf{18}_1$, to the displacing system 116.

Figure 15:
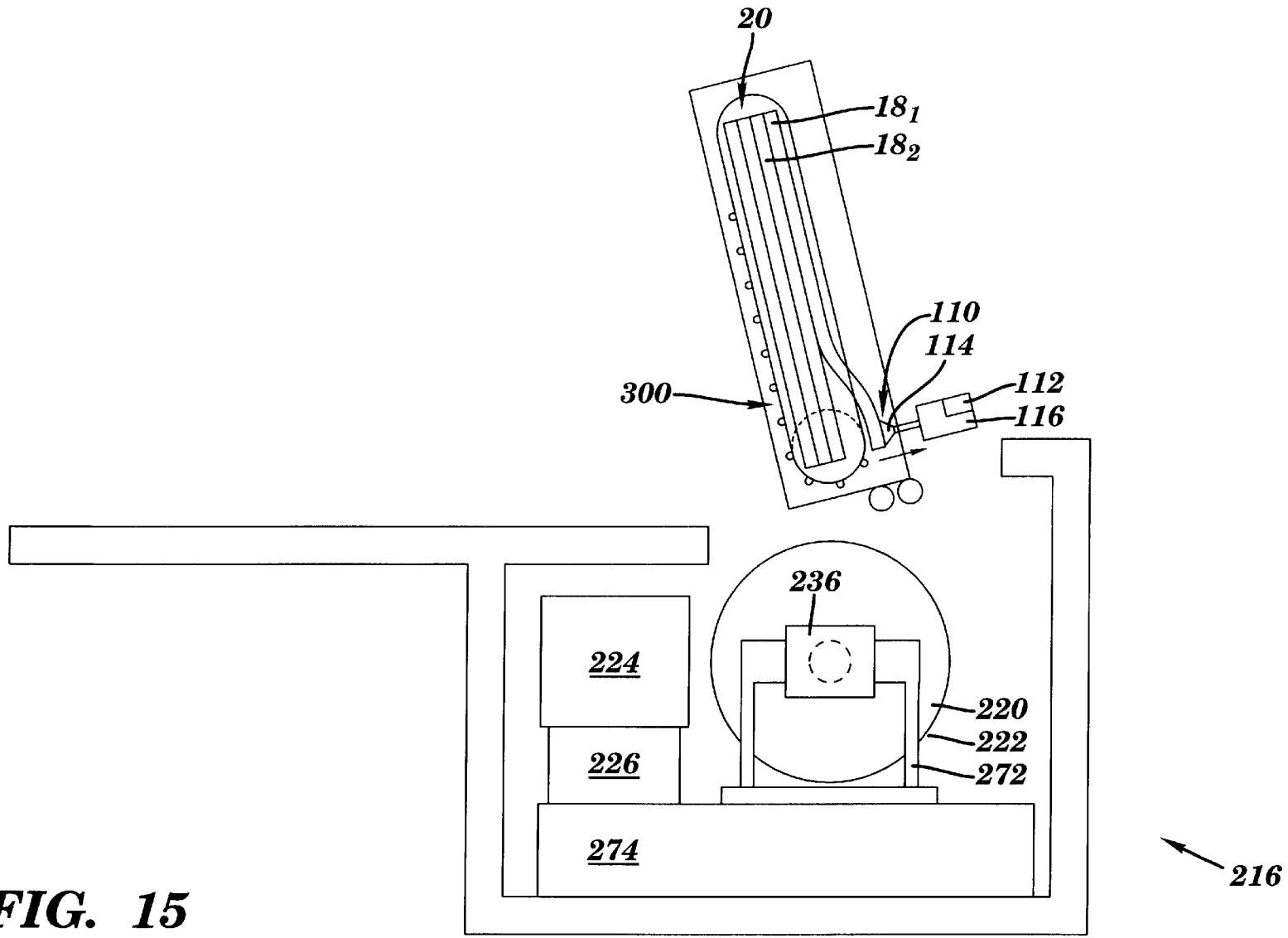
Figure 16:
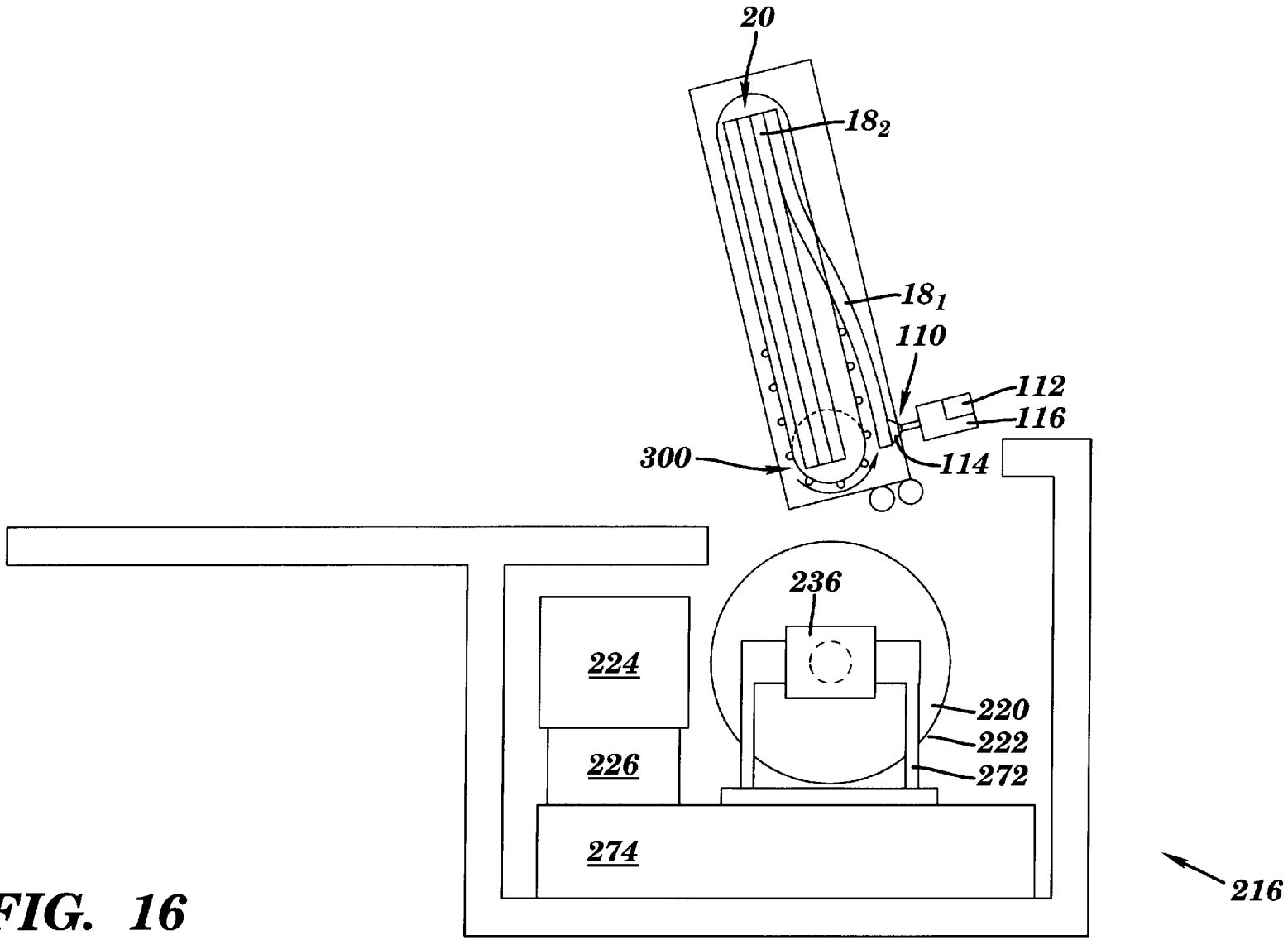
Figure 17:
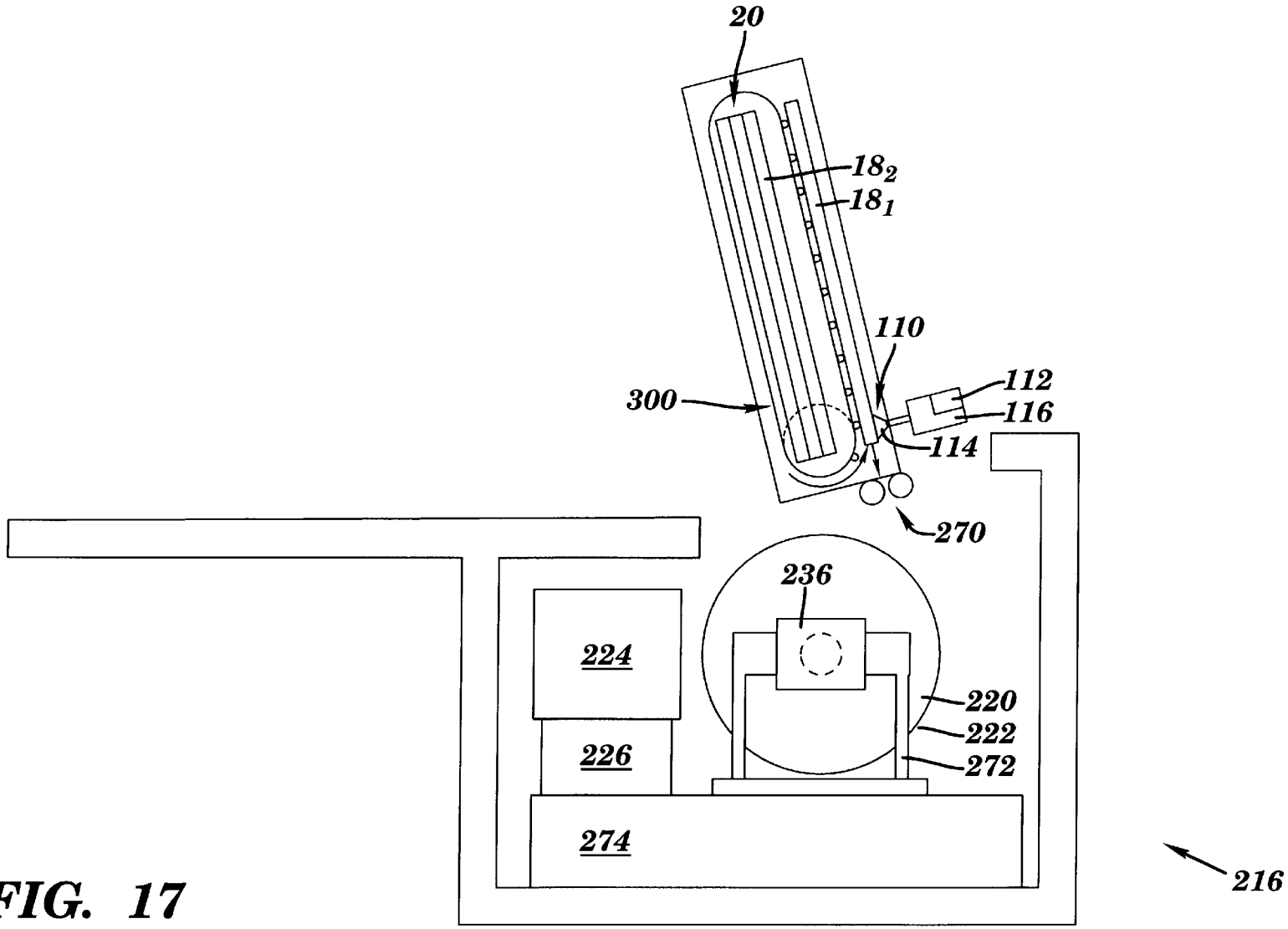
Figure 18:
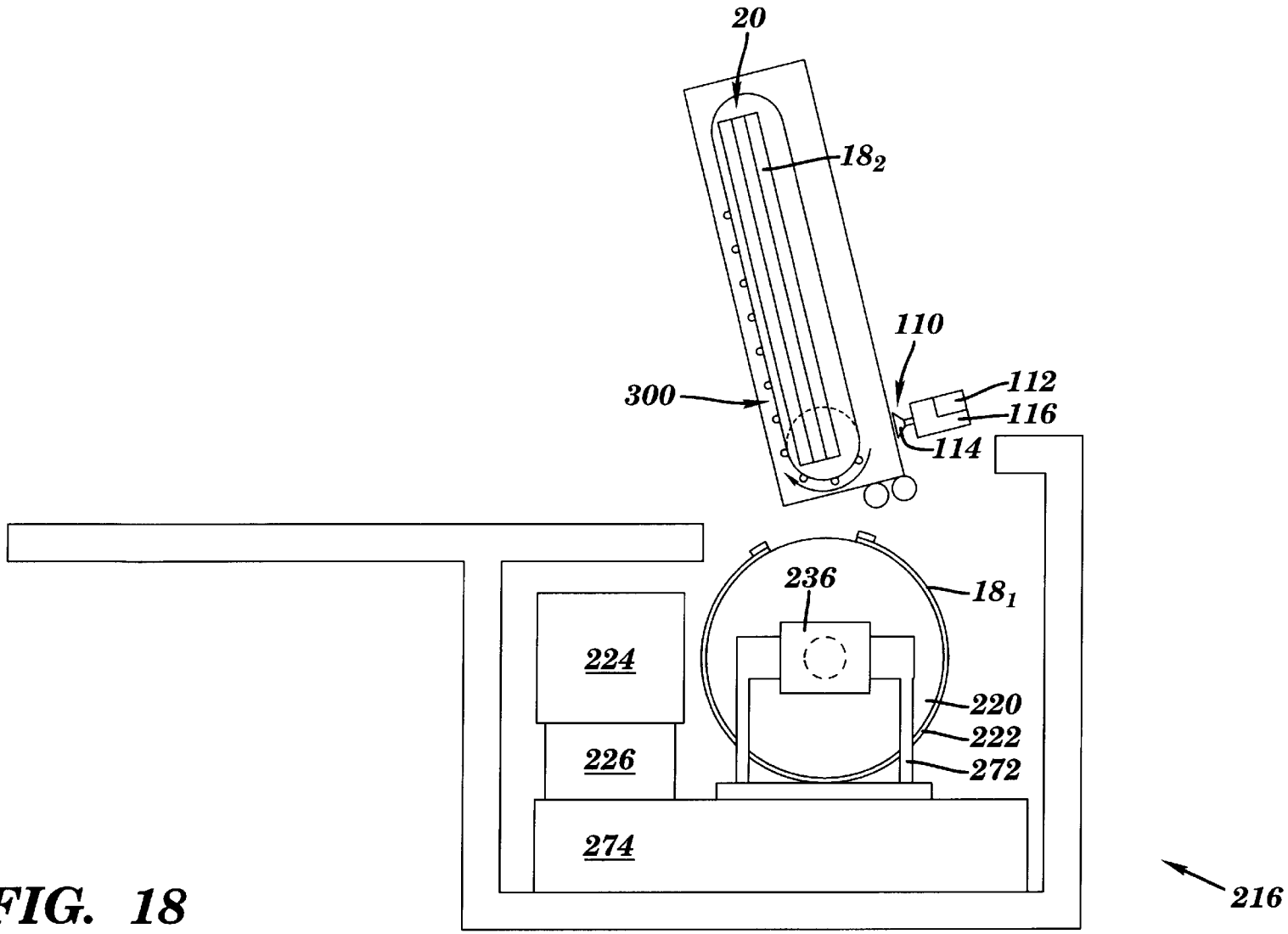

In FIG. 15, the bottom edge of the top printing plate $\mathbf{18}_1$ is peeled away from the stack 20 of printing plates by the displacing system 116. At this point, a printing plate supporting and feeding system 300 is actuated to peel the top printing plate $\mathbf{18}_1$, away from, and off of, the next printing plated $\mathbf{18}_2$ of the stack 20. The printing plate supporting and feeding system 300 continues to operate (FIG. 16) until the top printing plate $\mathbf{18}_1$, is fully peeled off of the stack 20 (FIG. 17). With the suction cups 114 still attached by vacuum to the top printing plate $\mathbf{18}_1$, the displacing system 116 (and attached top printing plate $\mathbf{18}_1$) may be shifted downward to position the edge of the top printing plate $\mathbf{18}_1$, at or within a pair of nip rollers 270. The nip rollers 270 operate to direct the bottom (i.e., leading) edge of the top printing plate $\mathbf{18}_1$, to a plate mounting system (not shown) that is configured to mount the printing plate onto the external drum 220 of the external drum platesetter 216 for subsequent imaging. The top printing plate $\mathbf{18}_1$, is shown mounted to the external drum 220 in FIG. 18. Such a mounting system is disclosed in detail, for example, in U.S. Pat. No. 6,295,929, entitled "External Drum Imaging System," which is incorporated herein by reference.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention.

We claim:

1. An apparatus, comprising:

a vacuum system including a vacuum source and plurality of suction cups coupled to the vacuum source, wherein at least one of the suction cups is coupled to the vacuum source using a non-constricted fitting, and wherein at least one of the suction cups is coupled to vacuum source using a fixed orifice fitting; and a stack of printing plates;

wherein the vacuum system is configured to pick a top printing plate from the stack of printing plates, and wherein each suction cup coupled to the vacuum source using the non-constricted fitting is configured to always engage the top printing plate.

2. The apparatus of claim 1, wherein at least two of the suction cups are coupled to the vacuum source using the non-constricted fitting, and wherein the remaining suction cups are coupled to the vacuum source using the fixed orifice fittings.

3. The apparatus of claim 1, wherein, if the printing plates in the stack of printing plates are center justified with respect to each other, then the at least one suction cup coupled to the vacuum source using the non-constricted fitting is center justified with respect to the plurality of suction cups.

4. The apparatus of claim 1, wherein, if the printing plates in the stack of printing plates are left justified with respect to each other, then the at least one suction cup coupled to the vacuum source using the non-constricted fitting is left justified with respect to the plurality of suction cups.

5. The apparatus of claim 1, wherein, if the printing plates in the stack of printing plates are right justified with respect to each other, then the at least one suction cup coupled to the vacuum source using the non-constricted fitting is right justified with respect to the plurality of suction cups.

6. The apparatus of claim 1, wherein a width of each printing plate in the stack of printing plates is larger than an effective width of the suction cups.

7. The apparatus of claim 1, wherein a width of each printing plate in the stack of printing plates is smaller than an effective width of the suction cups.

8. The apparatus of claim 1, further comprising tubing for connecting each non-constricted and fixed orifice fitting to the vacuum source.

9. The apparatus of claim 1, wherein the vacuum source comprises a vacuum pump.

10. The apparatus of claim 1, wherein each non-constricted fitting has a bore with a constant diameter.

11. The apparatus of claim 1, wherein each fixed orifice fitting comprises a first bore having a diameter and a second bore having a diameter, and wherein the diameter of the second bore is substantially smaller than the diameter of the first bore.

12. The apparatus of claim 1, wherein the stack of printing plates is located within a cassette.

13. The apparatus of claim 1, further comprising:

a media support surface;

a mounting system for mounting the top printing plate, picked of the stack of printing plates by the vacuum system, on the media support surface; and a scanning system for imaging data onto the top printing plate.

14. The apparatus of claim 13, wherein the media support surface comprises an external drum.

15. A method, comprising:

providing a vacuum system including a vacuum source and plurality of suction cups coupled to the vacuum source;

coupling at least one of the suction cups to the vacuum source using a non-constricted fitting;

coupling at least one of the suction cups to the vacuum source using a fixed orifice fitting; and picking a top printing plate from a stack of printing plates using the vacuum system, wherein each suction cup coupled to the vacuum source using the non-constricted fitting is configured to always engage the top printing plate.

16. The method of claim 15, further including:

coupling at least two of the suction cups to the vacuum source using the non-constricted fitting; and coupling the remaining suction cups to the vacuum source using the fixed orifice fittings.

17. The method of claim 15, further including:

center justifying the printing plates in the stack of printing plates with respect to each other; and center justifying the at least one suction cup coupled to the vacuum source using the non-constricted fitting.

18. The method of claim 15, further including:

left justifying the printing plates in the stack of printing plates with respect to each other; and left justifying the at least one suction cup coupled to the vacuum source using the non-constricted fitting.

19. The method of claim 15, further including:

right justifying the printing plates in the stack of printing plates with respect to each other; and right justifying the at least one suction cup coupled to the vacuum source using the non-constricted fitting.

20. The method of claim 15, wherein a width of each printing plate in the stack of printing plates is larger than an effective width of the suction cups.

21. The method of claim 15, wherein a width of each printing plate in the stack of printing plates is smaller than an effective width of the suction cups.

22. The method of claim 15, further including connecting each non-constricted and fixed orifice fitting to the vacuum source via tubing.

23. The method of claim 15, further including providing each non-constricted fitting with a bore having a constant diameter.

24. The method of claim 15, further including providing each fixed orifice fitting with a first bore having a diameter and a second bore having a diameter, wherein the diameter of the second bore is substantially smaller than the diameter of the first bore.

25. The method of claim 15, further including locating the stack of printing plates within a cassette.

26. The method of claim 15, further including:

providing a media support surface;

mounting the top printing plate, picked of the stack of printing plates by the vacuum system, on the media support surface; and imaging data onto the top printing plate.

27. The method of claim 26, wherein the media support surface comprises an external drum.

28. A method for picking and holding an object, comprising:

providing a vacuum system including a vacuum sources and plurality of suction cups coupled to the vacuum source;

coupling at least one of the suction cups to the vacuum source using a non-constricted fitting;

coupling at least one of the suction cups to the vacuum source using a fixed orifice fitting; and picking and holding an object using the vacuum system, wherein each suction cup coupled to the vacuum source using the non-constricted fitting always engages and holds the object, wherein zero or more of the suction cups coupled to the vacuum source using the fixed orifice fitting engage and hold the object, and wherein vacuum leakage through any suction cups that do not engage the object does not substantially affect a vacuum level within the suction cups that do engage the object.

29. The method of claim 28, wherein the object comprises a printing plate.

* * * * *